United States Patent [19]

Wankel

[11] 4,032,268

[45] June 28, 1977

[54] ROTARY PISTON ENGINE

[75] Inventor: Felix Wankel, Lindau, Germany

[73] Assignee: Wankel GmbH, Berlin, Germany

[22] Filed: Mar. 5, 1975

[21] Appl. No.: 555,501

[30] Foreign Application Priority Data

Mar. 7, 1974 Germany ..... 2411004

[52] U.S. Cl. ..... 418/91; 418/179; 308/163

[51] Int. Cl.[2] ..... F04C 27/00

[58] Field of Search ..... 418/61 A, 83, 179; 308/161, 162, 163, 164–167

[56] References Cited

UNITED STATES PATENTS

| | | | |
|---|---|---|---|
| 1,994,786 | 3/1935 | Redfield | 418/134 |
| 3,002,794 | 10/1931 | Bluemink | 308/163 |
| 3,033,180 | 5/1962 | Bentele | 418/179 |
| 3,111,261 | 11/1963 | Bentele et al. | 418/179;83 |
| 3,112,870 | 12/1963 | Bentele | 418/61 A |
| 3,196,851 | 7/1965 | Jungbluth | 418/83 |
| 3,259,114 | 7/1966 | Gassmann | 418/83 |
| 3,291,059 | 12/1966 | Werra | 418/179 |
| 3,302,622 | 2/1967 | Jones | 418/61 A |
| 3,363,950 | 1/1968 | Cole | 308/163 |
| 3,483,694 | 12/1969 | Huber et al. | 418/61 A |
| 3,500,797 | 3/1970 | Scheufler | 418/179 |
| 3,528,757 | 9/1970 | Ware | 418/179 |
| 3,545,901 | 12/1970 | Belzner | 418/179 |
| 3,652,190 | 3/1972 | Keller et al. | 418/179 |
| 3,771,904 | 11/1973 | Ruf | 418/179 |
| 3,825,377 | 7/1974 | Bottoms | 418/179 |
| 3,826,597 | 7/1974 | Schmitz | 418/131 |
| 3,964,843 | 6/1976 | Terazawa | 418/83 |
| 3,989,423 | 11/1976 | Rue et al. | 418/179 |

FOREIGN PATENTS OR APPLICATIONS

| | | | |
|---|---|---|---|
| 1,451,859 | 12/1970 | Germany | 418/61 A |

*Primary Examiner*—C. J. Husar
*Attorney, Agent, or Firm*—Jones, Tullar & Cooper

[57] ABSTRACT

A rotary piston engine is provided which is suitable for working or conveying media in the form of hot deposit-forming gases or vapors. The engine comprises a housing and a rotor mounted rotatably within the housing. The clearance between the rotor and the housing increases as the engine temperature decreases and decreases as the engine temperature increases. This can be achieved by making the rotor of a material having a higher coefficient of expansion than the material of the housing, and/or by cooling the rotor to a lesser extent than the housing.

10 Claims, 3 Drawing Figures

ROTARY PISTON ENGINE

FIELD OF THE INVENTION

This invention relates to an internal-axle or external-axle rotary piston engine, more especially a rotary piston expansion engine for working or conveying media in the form of hot deposit-forming gases or vapours.

Engines of the kind in question may be powered by hot gases or vapours of this kind or, for example in chemical processes, may be engines which convey or compress media of this kind.

DESCRIPTION OF THE PRIOR ART

It is known that rotary piston expansion engines can be used to drive superchargers of internal combustion engines, rotating in the hot exhaust-gas stream thereof. German Patent Specification No. 1,008,754 (DAS No. 1,301,611) relates to a trochoid-type internal-axle radial piston engine with a transmission ratio of 2:3, of which the power take-up side functions as a supercharger for an internal combustion engine, whilst its power output side functions as an expansion engine driven by the hot exhaust gases from the same internal combustion engine. In this proposed arrangement, the difficulties encountered in machines of this kind both on account of thermal expansion and on account of the accumulation of combustion residues from the internal combustion engine are obviated by a sealing system with movable seals. Unfortunately, this sealing system is extremely expensive. In addition, it requires lubrication, so that partly burnt residues of the lubricants are undesirably discharged into the atmosphere. By contrast, German Offenlegungsschrift No. 2,232,592 relates to an exhaust supercharger consisting of two external-axle rotary piston engines arranged on the same shaft. The power-generating rotary piston engine is driven by the hot exhaust gases of the supercharged internal combustion engine and does not have any movable seals, but instead forms the narrowest of gaps in order to avoid significant losses through leakage. The rotor of the rotating engine is able with its sealing edges to strip off the deposits down to the narrowest of gaps, solid deposits of the working medium being required to a certain extent in order effectively to seal off the engine. Unfortunately, at relatively low rotational speeds and under relatively weak loads and especially after it has been brought to a standstill, the machine is in danger of seizing due to the fall-back in the thermal expansion of its housing or, after having been brought to a standstill and started up again, is in danger of being blocked by deposits of solid carbon layers or clogging polymers emanating from the fuels and lubricants and carbon. It is not advisable to obviate these disadvantages by enlarging the gaps, because even relatively wide gaps become blocked over a period of time. In addition, the efficiency of the engine would be very considerably reduced by enlarging the gaps. For these reasons, there has been so much prejudice that engines of this kind, except for those described here, have neither been described nor constructed.

SUMMARY OF THE INVENTION

The object of the invention is to prevent engines of this kind which are only gap-sealed from seizing when cold or when operating under relatively weak loads.

According to the invention the engine comprises a housing and a rotor mounted rotatably within the housing. The clearance between the rotor and the housing increases as the engine temperature decreases and decreases as the engine temperature increases. This can be achieved by making the rotor of a material having a higher coefficient of expansion than the material of the housing, and/or by cooling the rotor to a lesser extent than the housing. In addition, the axial play of the rotor is limited in accordance with the invention in such a way that it rotates centrally in the housing and its thermal expansion is in no way adversely affected by the restriction of axial play.

BRIEF DESCRIPTION OF THE DRAWINGS

Exemplary embodiments of the invention are described in detail in the following with reference to FIGS. 1 to 3 of the accompanying drawings.

DESCRIPTION OF THE PREFERRED EMBODIMENTS

Figure 1:
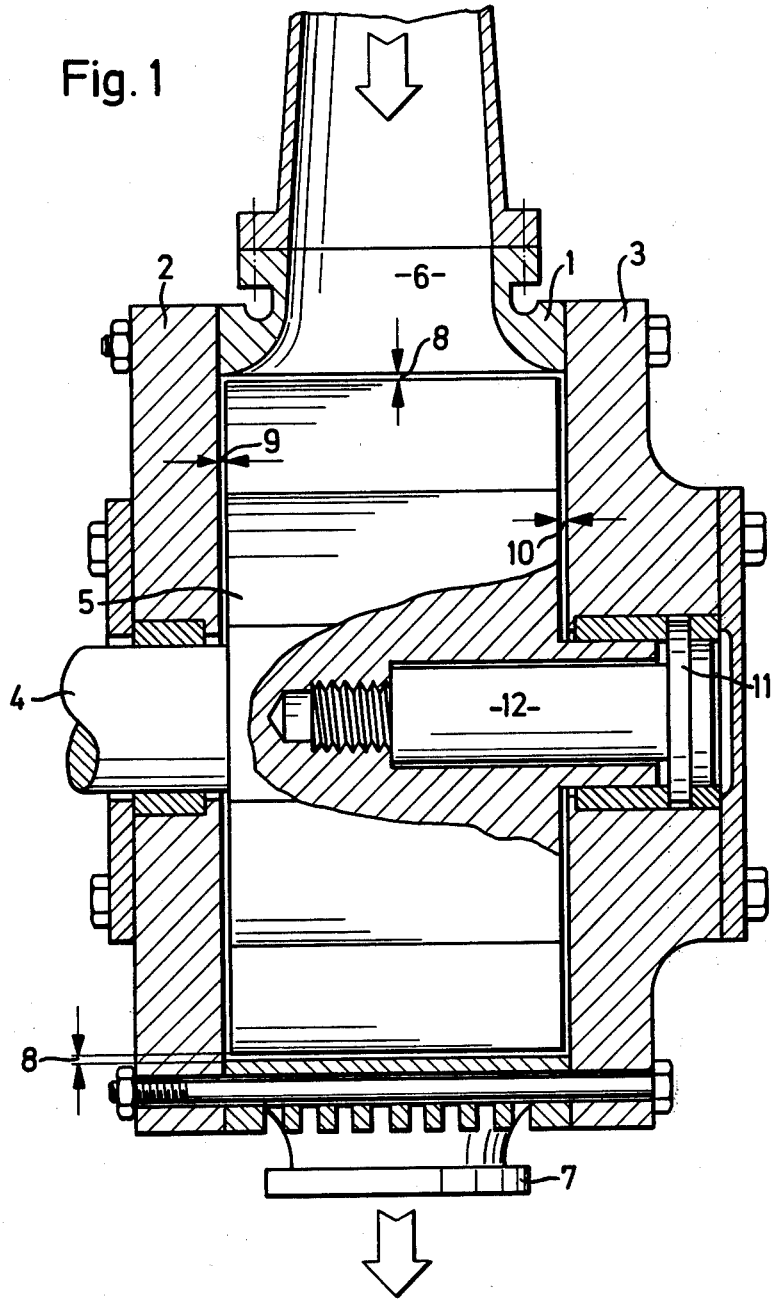

The rotary piston engine shown in longitudinal sections in the drawing comprises a housing 1 and two end plates 2 and 3. A rotor 5 is mounted on the shaft 4. The gas heated in the combustion chamber or internal combustion engine enters through the inlet 6, drives the rotor 5 and leaves through the outlet 7. Between the inner walls of the housing 1 and the rotor 5 there is a gap 8, whilst between the inner walls of the side plates 2 and 3 and the rotor 5 there are gaps 9 and 10. Deposits consisting of oil carbon, polymers of the incompletely burnt lubricants and fuels of the hot-gas generator, carbon and the like, are formed from the combustion gases on the inner walls of the housing 1 and on the outer periphery of the rotor 5, on the inner walls of the side plates 2 and 3 and on the outer walls of the rotor 5.

Axial play is limited by means of one double-acting thrust bearing 11, which is connected to the rotor by an Invar rod 12, or by two single-acting thrust bearings 13 and 14 with the axial clearances 15 and 16 which act directly on the rotor 5.

The rotor may initially be installed with fairly considerable play in the housing, because the gaps are reduced in size by deposits during operation. In operation, the deposits are automatically stripped away at those areas where they interfere with the rotational movement, so that the engine functions with the narrowest of radial gaps.

The narrowest possible gap in the radial direction is governed by the arrangement of the system used to limit axial play. Tests have shown that it is not possible to limit axial play for both directions on only one side of the bearing, because in that case the rotor would only expand in the direction of the loose bearing. Accordingly, the layer of deposit building up at the front end of the loose bearing will remain relatively thin, and in the event of reductions in load or when the engine is brought to a standstill the cooling rotor will move relatively far away from that end.

In the case of the fixed bearing, the situation is reversed at the front end of the rotor and housing. On cooling, the front end of the rotor will substantially retain its position relative to the layer of deposit built up there, and the short length of shaft between the end of the rotor and the fixed bearing will contract somewhat on cooling, so that the end of the rotor is locked by the layer of deposit.

In order to prevent this, it is necessary, in cases where axial play is limited on one side, but in two directions, to use an arrangement of the kind shown in FIG. 1. In this arrangement, the rotor 5 is connected to the bearing 11 which limits axial play by a rod 12 made of a material which undergoes very little expansion, for example Invar. One end of the Invar rod 12 is fixed to the axial centre of the rotor 5, whilst the other end is connected to the bearing 11 which limits axial play. As a result, the rotor 5 is able to expand or contract uniformly at both ends.

Figure 2:
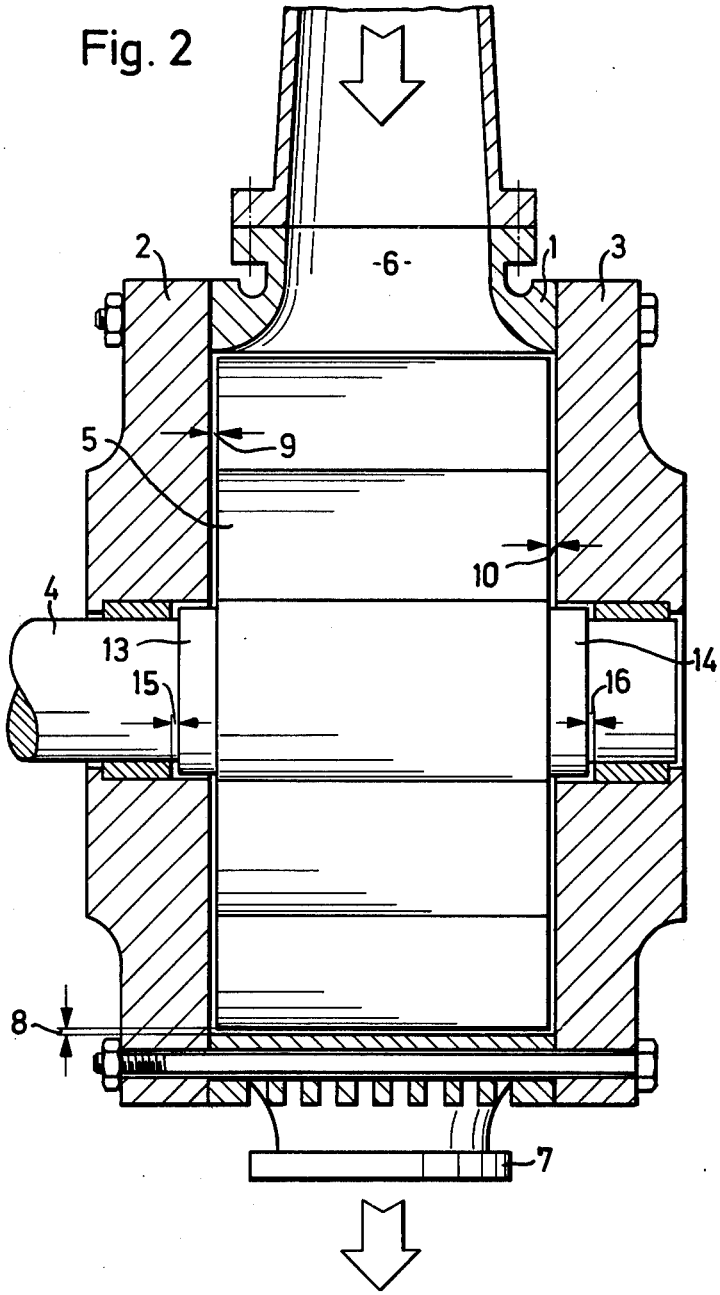
Figure 3:
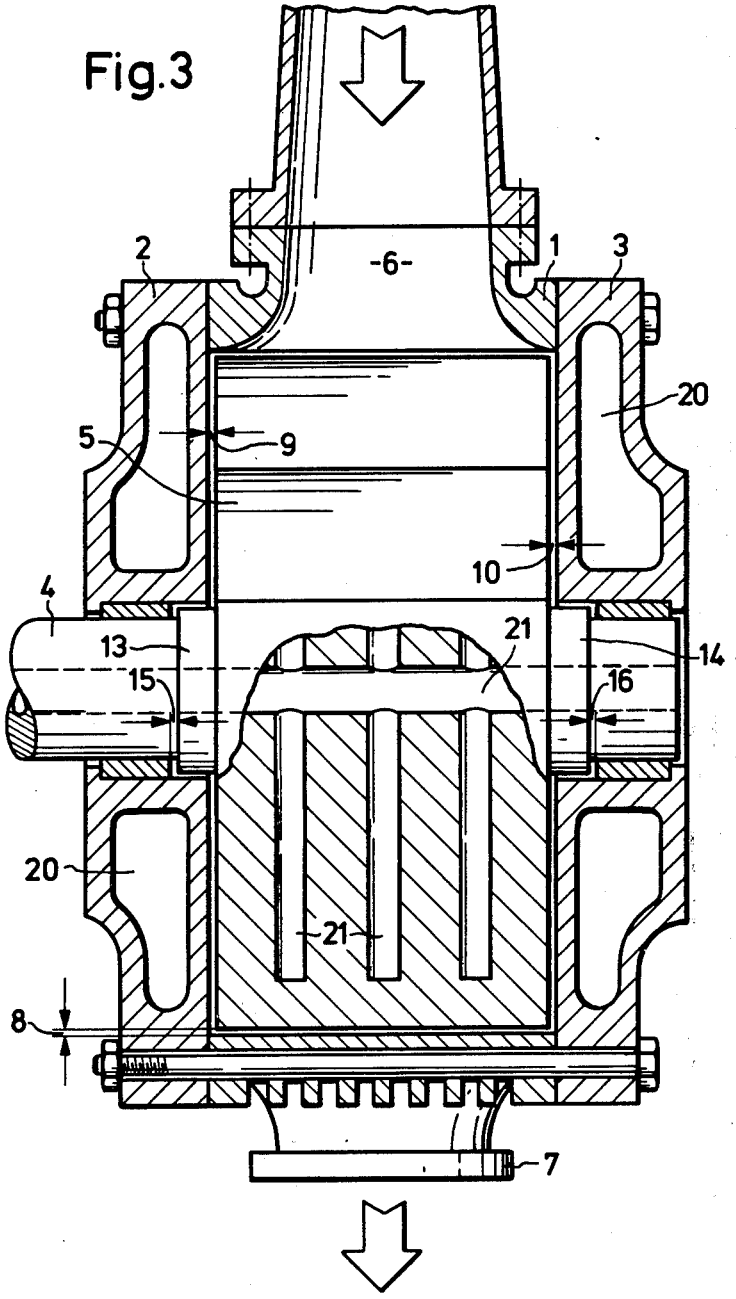

Another arrangement according to the invention for limiting axial play is illustrated in FIG. 2 and comprises a means for limiting axial play acting in one direction only in the axial bearings 13 and 14 of the rotor shaft arranged on either side of the rotor. The clearances 15 and 16 of the two axial bearings have to be adjusted in such a way that the rotor is able to expand axially under heat. Only then is the narrowest axial play obtained. FIG. 3 shows an arrangement which corresponds to FIG. 2 and shows a liquid cooling system. This system consists of a coolant flow path 20 in the housing and of a coolant flow path 21 in the piston, the piston having portions broken away to show portions of flow path 21. It will be understood that this showing of such a liquid cooling system is intended as exemplary of any number of generally known cooling means which could be utilized in the present invention.

In both thrust bearing arrangements, it is of advantage according to the invention to provide for limited axial play to enable layers of deposit to be rubbed off to a limited extent in operation.

What I claim is:

1. In a rotary piston engine having a housing closed at its ends by first and second end plates, a rotor mounted on a shaft within said housing, said shaft being journalled in and extending through one of said end plates, said rotor being spaced from said housing and said end plates by means of radial and axial gaps, respectively, the improvement comprising:

means for decreasing said radial and axial gaps with increasing engine temperature and increasing said gaps with decreasing engine temperature to prevent seizing of said engine upon cooling.

2. An engine according to claim 1 wherein said means for decreasing said gaps with increasing engine temperature and increasing said gaps with decreasing engine temperature includes a rotor formed of a material having a higher coefficient of thermal expansion than the material of which the housing and end plates is formed.

3. An engine according to claim 2 further including cooling means for cooling the rotor to a lesser extent than the housing and end plates.

4. An engine according to claim 1 wherein said means for decreasing said gaps with increasing engine temperature and increasing said gaps with decreasing engine temperature includes cooling means for cooling the rotor to a lesser extent than the housing and end plates.

5. An engine according to claim 1, wherein the rotor is kept in an axial central position in the housing by a double-acting thrust bearing which is connected to the axial centre of the rotor by means of a rod made of a material which undergoes minimal thermal expansion.

6. An engine according to claim 5, wherein the thrust bearing of the rotor has an axial clearance which is less than the minimum permitted clearance between the rotor and the housing.

7. An engine according to claim 1, wherein thrust bearings are arranged to each end of the rotor to limit axial play of the rotor.

8. An engine according to claim 7, wherein the thrust bearings of the rotor have an axial clearance which is less than the minimum permitted clearance between the rotor and the housing.

9. An engine according to claim 1, wherein said means for decreasing and increasing said gaps includes first and second single-acting thrust bearings journalled in said first and second end plates, respectively, and receiving the rotor shaft, said thrust bearings each having an axial clearance which is less than the minimum permitted axial gap between the rotor and each of the end plates, and wherein said rotor is formed of a material having a higher coefficient of thermal expansion than the material of which the housing is formed.

10. An engine according to claim 9, wherein said thrust bearings axially position said rotor centrally within said housing and spaced equally from said end plates whereby said rotor expands or contracts uniformly at both ends upon changes in the temperature of said engine.

* * * * *